US010619605B2

(12) United States Patent
Kuske et al.

(10) Patent No.: US 10,619,605 B2
(45) Date of Patent: Apr. 14, 2020

(54) BOOSTED INTERNAL COMBUSTION ENGINE WITH LOW-PRESSURE EXHAUST-GAS RECIRCULATION ARRANGEMENT AND PIVOTABLE FLAP

(71) Applicant: Ford Global Technologies, LLC, Dearborn, MI (US)

(72) Inventors: Andreas Kuske, Geulle (NL); Christian Vigild, Aldenhoven (DE); Daniel Roettger, Eynatten (BE)

(73) Assignee: Ford Global Technologies, LLC, Dearborn, MI (US)

( * ) Notice: Subject to any disclaimer, the term of this patent is extended or adjusted under 35 U.S.C. 154(b) by 105 days.

(21) Appl. No.: 15/957,718

(22) Filed: Apr. 19, 2018

(65) Prior Publication Data

US 2018/0328318 A1 Nov. 15, 2018

(30) Foreign Application Priority Data

May 12, 2017 (DE) ..... 10 2017 208 070

(51) Int. Cl.
*F02M 26/70* (2016.01)
*F02M 26/04* (2016.01)

(52) U.S. Cl.
CPC ..... *F02M 26/70* (2016.02); *F02M 26/04* (2016.02)

(58) Field of Classification Search
CPC ..... F02M 26/70; F02M 26/04; F02M 26/64; F02M 26/21; F02M 26/06; F02B 47/10; F02B 37/12; F02B 29/02
USPC ..... 60/605.2; 123/568.17, 568.18
See application file for complete search history.

(56) References Cited

U.S. PATENT DOCUMENTS

2011/0248201 A1* 10/2011 Kuo ..... F16L 15/008 251/321
2015/0198119 A1* 7/2015 Kuske ..... F02M 26/71 60/605.2
2016/0017846 A1* 1/2016 Hodebourg ..... F02B 29/0418 137/625.44
2018/0058341 A1* 3/2018 Kuske ..... F02D 9/1015

FOREIGN PATENT DOCUMENTS

DE 202016105725 U1 10/2016

* cited by examiner

*Primary Examiner* — Hoang M Nguyen
(74) *Attorney, Agent, or Firm* — Geoffrey Brumbaugh; McCoy Russell LLP

(57) ABSTRACT

An engine system is provided that includes a compressor including an inlet upstream of an impeller and a compressor housing, a flow-guiding device including a first partition extending across a valve housing, where the valve housing defines a boundary of an airflow duct, and a valve unit including an exhaust gas recirculation (EGR) valve coupled to a junction point between an EGR conduit and a compressor inlet and including and a flap having a recess mating with the first partition and pivoting about a mounting interface adjacent to a leading edge of the flap, a valve housing coupled to the compressor housing, where during actuation of the EGR valve a relative position between the recess in the flap and the first partition is varied.

20 Claims, 5 Drawing Sheets

BOOSTED INTERNAL COMBUSTION ENGINE WITH LOW-PRESSURE EXHAUST-GAS RECIRCULATION ARRANGEMENT AND PIVOTABLE FLAP

CROSS REFERENCE TO RELATED APPLICATION

This application claims priority to German Patent Application No. 102017208070.1, filed May 12, 2017. The entire contents of the above-referenced application are hereby incorporated by reference in their entirety for all purposes.

FIELD

The present description relates generally to an engine system with a compressor and an exhaust-gas recirculation (EGR) valve having a pivotal flap.

BACKGROUND/SUMMARY

In recent years, there has been a trend in development toward supercharged engines, wherein the economic significance of said engines for the automobile construction industry continues to steadily increase. Supercharging is used to increase engine power such that the air in the combustion process in the engine is compressed, as a result of which a greater air mass can be fed to each cylinder in each working cycle. In this way, the fuel mass and therefore the mean pressure can be increased. In this way, supercharging may increase the power of an internal combustion engine while maintaining an unchanged swept volume, or may reduce the swept volume while maintaining the same power. In all cases, supercharging leads to an increase in volumetric power output and a more expedient power-to-weight ratio. If the swept volume is reduced, it is thus possible to shift the load collective toward higher loads, at which the specific fuel consumption is lower. Supercharging consequently assists in constant efforts in the development of internal combustion engines to reduce fuel consumption, that is to say to improve the efficiency of the internal combustion engine. Using a suitable transmission configuration, it is additionally possible to realize so-called downspeeding, whereby a lower specific fuel consumption is likewise achieved. In the case of downspeeding, use is made of the fact that the specific fuel consumption at low engine speeds is generally lower, in particular in the presence of relatively high loads.

To address at least some of the aforementioned problems an engine system is provided. The engine system includes a compressor including an inlet upstream of an impeller and a compressor housing, a flow-guiding device including a first partition extending across a valve housing, where the valve housing defines a boundary of an airflow duct, and a valve unit including an exhaust gas recirculation (EGR) valve coupled to a junction point between an EGR conduit and a compressor inlet and including and a flap having a recess mating with the first partition and pivoting about a mounting interface adjacent to a leading edge of the flap, a valve housing coupled to the compressor housing, where during actuation of the EGR valve a relative position between the flap and the first partition is varied. The interaction between the partition and the flap recess enables the gas flow (e.g., EGR gas flow and fresh air flow) entering the compressor to be separated to reduce the likelihood of condensation formation. As such, the likelihood and/or amount of condensate droplets striking the impeller is reduced. Consequently, noise generated in the intake system may be reduced and the likelihood of damage to the blades of the impeller are also reduced, thereby increasing compressor efficiency and compressor longevity.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1A-4 are shown approximately to scale. However, other relative dimensions may be used, in other examples, if desired.

DETAILED DESCRIPTION

Figure 1A:
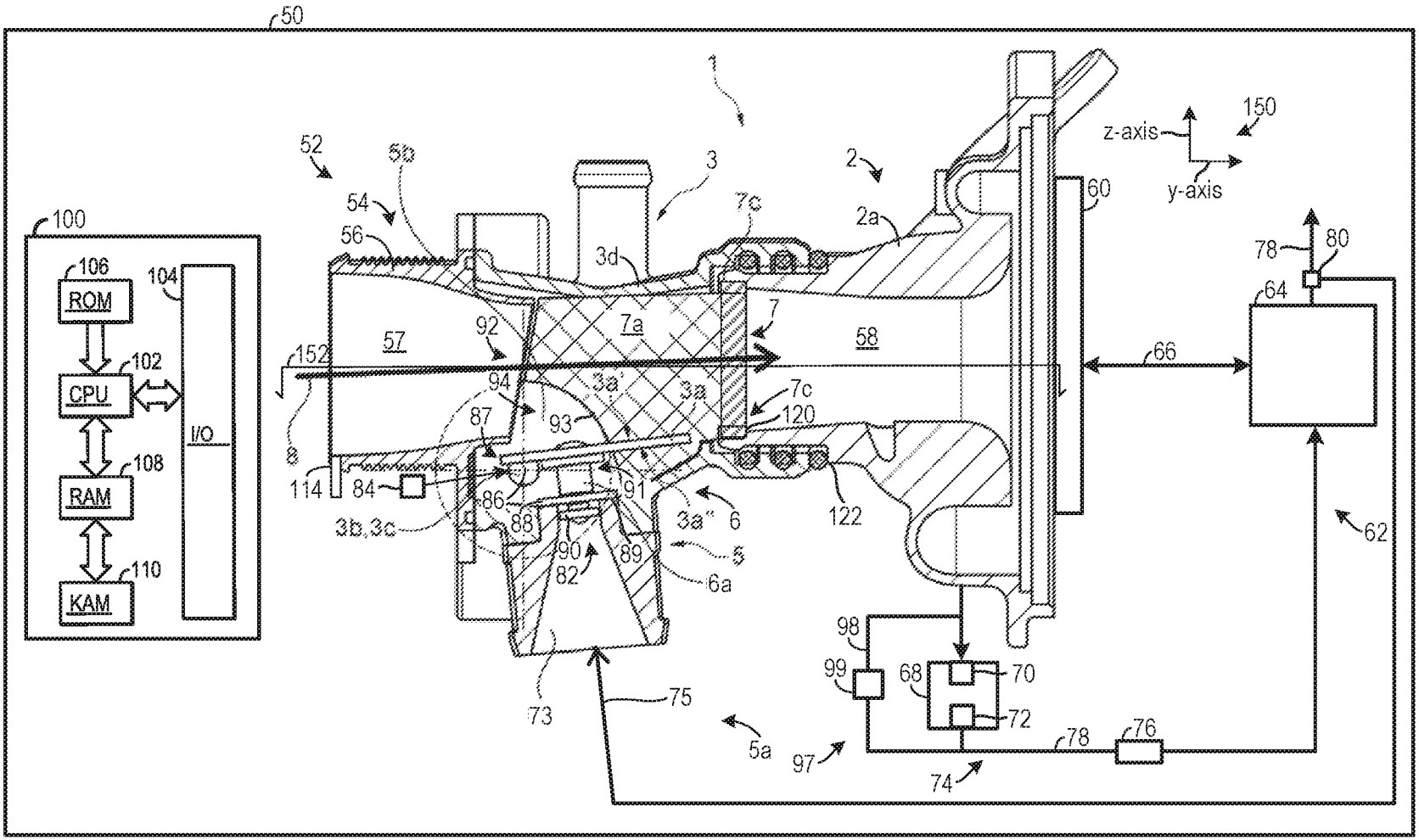
FIG. 1A shows, in a side view, a valve unit, arranged in an intake system, of a first example of the internal combustion engine together with exhaust-gas recirculation arrangement, partially in section and with the flap in a closed position.

Boosting devices such as turbocharger or superchargers have been used in internal combustion engines to increase the engine's power to weight ratio. For boosting, use is often made of an exhaust-gas turbocharger, in which a compressor and a turbine are arranged on the same shaft. The hot exhaust-gas flow is fed to the turbine and expands in the turbine with a release of energy, as a result of which the shaft is set in rotation. The energy released by the exhaust-gas flow to the turbine and ultimately to the shaft is used for driving the compressor which is likewise arranged on the shaft. The compressor conveys and compresses the charge air fed to it, as a result of which boosting of the cylinders is obtained. A charge-air cooler may be provided in the intake system downstream of the compressor. The charge air cooler may function to cool the compressed charge air before it enters the at least one cylinder. The cooler lowers the temperature and thereby increases the density of the charge air, such that the cooler also contributes to improved charging of the cylinders, that is to say to a greater air mass. Compression by cooling takes place.

The advantage of an exhaust-gas turbocharger in relation to supercharging—which can be driven by an auxiliary drive—is that an exhaust-gas turbocharger utilizes the exhaust-gas energy of the hot exhaust gases, whereas a supercharger draws energy directly or indirectly from the internal combustion engine and thus adversely affects, that is to say reduces, the efficiency, at least as long as the drive energy does not originate from an energy recovery source.

If the supercharger is not drive by an electric machine, that is to say electrically, a mechanical or kinematic connection for power transmission may be needed between the supercharger and the internal combustion engine, which also may influence the packaging in the engine bay.

One potential advantage of a supercharger in relation to an exhaust-gas turbocharger is that the supercharger can generate, and make available, charge pressure during a greater window of engine operation. In one example, superchargers may provide boost regardless of the operating state of the internal combustion engine. This may apply in particular to a supercharger which can be driven electrically by an electric machine, and is therefore independent of the rotational speed of the crankshaft.

In the prior art, it is specifically the case that difficulties are encountered in achieving an increase in power in all engine speed ranges by exhaust-gas turbocharging. A relatively severe torque drop is observed in the event of a certain engine speed being undershot. Said torque drop is understandable if one takes into consideration that the charge pressure ratio is dependent on the turbine pressure ratio or the turbine power. If the engine speed is reduced, this leads to a smaller exhaust-gas mass flow and therefore to a lower turbine pressure ratio or a lower turbine power. Consequently, toward lower engine speeds, the boost pressure ratio likewise decreases. This equates to a torque drop.

The internal combustion engine, described herein relates has a compressor for supercharging purposes, wherein, both a supercharger that can be driven by an auxiliary drive and a compressor of an exhaust-gas turbocharger can be subsumed under the expression "compressor". With the targeted configuration of the supercharging described herein, it may be possible to obtain advantages not only with regard to the fuel consumption, that is to say the efficiency of the internal combustion engine, but also with regard to exhaust-gas emissions. With suitable supercharging for example of a diesel engine, the nitrogen oxide emissions can therefore be reduced with reduced efficiency losses or without any efficiency losses, in some instances.

At the same time, the hydrocarbon emissions may be positively influenced. The emissions of carbon dioxide, which correlate directly with fuel consumption, decrease in any case with falling fuel consumption.

To adhere to some pollutant emissions standards, however, further measures may be taken in addition to the supercharging arrangement. Here, the focus of the development work may be on inter alia the reduction of nitrogen oxide emissions, which are of high relevance in particular in diesel engines. Since the formation of nitrogen oxides is caused by an excess of air and/or high temperatures, one concept for lowering the nitrogen oxide emissions may involve developing combustion processes with lower combustion temperatures.

Here, exhaust-gas recirculation (EGR), that is to say the recirculation of combustion gases from the outlet side to the inlet side, may be expedient in achieving this aim, wherein it may be possible for the nitrogen oxide emissions to be reduced with increasing exhaust-gas recirculation rate. Here, the exhaust-gas recirculation rate $x_{EGR}$ is determined as $x_{EGR}=m_{EGR}/(m_{EGR}+m_{air})$, where $m_{EGR}$ denotes the mass of recirculated exhaust gas and main denotes the supplied air. The oxygen provided via exhaust-gas recirculation must possibly be taken into consideration.

To obtain a reduction in nitrogen oxide emissions, high exhaust-gas recirculation rates may be used which may be of the order of magnitude of $x_{EGR}\approx 60\%$ to 70%, in one example.

The internal combustion engine according described herein, may be supercharged by a compressor may also be equipped with an exhaust-gas recirculation arrangement. In the exhaust-gas recirculation arrangement a recirculation line may branches off from the exhaust-gas discharge system and opens into the intake system, so as to form a junction point, upstream of the compressor, as is the case in a low-pressure EGR arrangement, in which exhaust gas that has already passed through a turbine arranged in the exhaust-gas discharge system is recirculated to the inlet side. For this purpose, the low-pressure EGR arrangement may include a recirculation line which branches off from the exhaust-gas discharge system downstream of the turbine and opens into the intake system, upstream of the compressor, in one example. However, in other examples, the EGR gas may be discharged downstream of the compressor.

The internal combustion engine described herein may also have a valve unit that is arranged in the intake system at the junction point. The valve unit may include a valve housing and a flap arranged in the valve housing.

The flap, which may be delimited circumferentially by an edge, may serve for the adjustment of the fresh-air flow rate supplied via the intake system, and, in interaction with other components, for the metering of the exhaust-gas flow rate recirculated via the exhaust-gas recirculation arrangement, and may be pivotable about an axis running transversely with respect to the fresh-air flow, in such a way that, in a first end position, the front side of the flap blocks the intake system, and at the same time the recirculation line may be opened up, and in a second end position, the back side of the flap covers the recirculation line, and at the same time the intake system is opened up. In the above context, both "blocking" and "covering" do not imperatively also mean "closing", or complete blocking and covering.

The axis, running transversely with respect to the fresh-air flow, about which the flap is pivotable need not be a physical axle. Rather, said axis may be a virtual axis, the position of which in relation to the rest of the intake system may furthermore exhibit a small amount of play, wherein the mounting or fastening may be realized in some other way.

Problems may arise, when the exhaust-gas recirculation arrangement is active, if exhaust gas is introduced into the intake system upstream of the compressor. Specifically, condensate may form. In this context, several scenarios are of relevance.

Firstly, condensate may form if recirculated hot exhaust gas meets, and is mixed with, cool fresh air. The exhaust gas cools down, whereas the temperature of the fresh air is increased. The temperature of the mixture of fresh air and recirculated exhaust gas, that is to say the charge-air temperature, lies below the exhaust-gas temperature of the recirculated exhaust gas. During the course of the cooling of the exhaust gas, liquids previously contained in the exhaust gas still in gaseous form, in particular water, may condense if the dew point temperature of a component of the gaseous charge-air flow is undershot.

Condensate formation occurs in the free charge-air flow, contaminants in the charge air often forming the starting point for the formation of condensate droplets. In this context, it may be taken into consideration that, when the exhaust-gas recirculation arrangement is active, the exhaust gas may flow or wash around the flap, and mixing of exhaust gas and fresh air may take place already in the valve housing, directly upon the introduction of the exhaust gas at the junction point.

Secondly, condensate may form when hot exhaust gas and/or the charge air impinges on the internal wall of the intake system or on the internal wall of the valve housing or on the flap, as the wall temperature may generally lie below the dew point temperature of the relevant gaseous components.

The problem of condensate formation may be intensified with increasing recirculation rate because, with the increase of the recirculated exhaust-gas flow rate, the fractions of the individual exhaust-gas components in the charge air, in particular the fraction of the water contained in the exhaust gas, inevitably increase. In the prior art, therefore, the exhaust-gas flow rate recirculated via the low-pressure EGR arrangement is commonly limited in order to prevent or reduce the occurrence of condensation. The limitation of the low-pressure EGR on the one hand and the high exhaust-gas recirculation rates desired for a considerable reduction in the nitrogen oxide emissions on the other hand may lead to different aims in the dimensioning of the recirculated exhaust-gas flow rate. The environmental requirements for the reduction of the nitrogen oxide emissions highlight the high relevance of this problem in practice. According to the prior art, it is therefore generally the case that an additional exhaust-gas recirculation arrangement, specifically a high-pressure EGR arrangement, may be provided, the recirculation line of which opens into the intake system downstream of the compressor. The internal combustion engine described herein may also additionally have a high-pressure EGR arrangement.

Condensate and condensate droplets are undesirable and lead to increased noise emissions in the intake system, and possibly to damage of the blades of the at least one compressor impeller. The latter effect is associated with a reduction in efficiency of the compressor.

For this reason, the valve unit or the junction point, may in one example, be positioned adjacent (e.g., directly adjacent) to the compressor, that is to say arranged in the vicinity of the at least one impeller, such that a short distance Δ is formed. An arrangement of the valve unit close to the compressor shortens the path for the hot recirculated exhaust gas from the point at which it is introduced into the intake system at the junction point to the at least one impeller, such that the time available for the formation of condensate droplets in the free charge-air flow is reduced. A formation of condensate droplets may therefore be counteracted in this way.

In terms of construction, the above concept may be implemented by virtue of the valve housing—which also belongs to the intake system—being positioned, that is to say installed, between the upstream-situated intake system and the downstream-situated compressor housing. In the first end position, the front side of the flap may interact with the intake system arranged upstream of the flap, or with the walls of said intake system, such that the valve housing and the downstream-situated compressor may be substantially sealed off against the ingress of fresh air from the upstream-situated intake system.

It may be an objective of the engine and boosting system described herein to provide a boosted internal combustion engine where a valve housing in the boosting system may be improved in relation to the prior art, such that the formation of condensate in the free charge-air flow is reduced or impeded.

Said objective may be achieved by a boosted internal combustion engine having an intake system for the supply of a charge-air flow, an exhaust-gas discharge system for the discharge of exhaust gas, at least one compressor arranged in the intake system, which compressor is equipped with at least one impeller which is mounted, in a compressor housing, on a rotatable shaft, an exhaust-gas recirculation arrangement including a recirculation line which branches off from the exhaust-gas discharge system and which opens into the intake system, so as to form a junction point, upstream of the at least one impeller, an exhaust-gas recirculation arrangement comprising a recirculation line which branches off from the exhaust-gas discharge system and which opens into the intake system downstream of the at least one impeller, and a valve unit which is arranged at the junction point in the intake system and which includes a valve housing and a flap arranged in the valve housing, the flap, which is delimited circumferentially by an edge, being pivotable about an axis running transversely with respect to the fresh-air flow, in such a way that the flap, in a first end position, blocks the intake system by a front side and opens up the recirculation line and, in a second end position, covers the recirculation line by an exhaust-gas-side back side and opens up the intake system. In said internal combustion engine the flap has two spaced-apart, recesses, which recesses are formed so as to be open at that edge of the flap which is situated opposite the axis of rotation and extend perpendicular to the axis of rotation of the flap, and a flow-guiding device may be provided in the intake system between the axis of rotation of the flap and the at least one impeller, which flow-guiding device may include two spaced-apart partitions, the partitions may engage with the two recesses such that the partitions in interaction with the flap separate the fresh air and the recirculated exhaust gas from one another.

The intake system of the internal combustion engine described herein may be equipped with a flow-guiding device, which is arranged downstream of the flap or downstream of the axis of rotation of the flap. Said flow-guiding device may include two spaced-apart partitions which engage with two recesses of the flap, in each case one partition engaging into an associated recess. For this purpose, the recesses may be of open form at the edge of the flap which is situated opposite the axis of rotation and which faces toward the partitions.

The partitions, in interaction with the flap, separate the fresh air and the recirculated exhaust gas from one another, if not completely then at least to a considerable or relevant extent. The recirculated exhaust gas may not directly flow or wash around the flap, and mix with the fresh air, upon being introduced into the intake system at the junction point. Rather, the two gas phases remain separated from one another over a predefinable or selectable distance on their path to the compressor proceeding from the junction point.

Thus, the junction point at which the recirculated exhaust gas is introduced into the intake system, and the exhaust gas and the fresh air impinge on and mix with one another, is virtually displaced, specifically closer to the compressor or to the at least one impeller. The spacing A, or the distance covered by the hot recirculated exhaust gas from the point of introduction into the intake system at the junction point to the at least one impeller, may be virtually shortened. In this way, condensate formation in the free charge-air flow may be counteracted. A shorter distance and less time is available for the formation of condensate droplets, in such an engine system.

The objective of decreasing condensate formation may thereby be achieved, that is to say a boosted internal combustion engine is provided, the valve housing of which is improved in relation to the prior art, such that the formation of condensate in the free charge-air flow is reduced or impeded.

In the context of the exhaust-gas recirculation, it may be desirable for exhaust gas that has been subjected to exhaust-gas aftertreatment, in particular in a particle filter, to be conducted through the compressor. In this way, deposits in the compressor which change the geometry of the compressor, in particular the flow cross sections, and impair the efficiency of the compressor, can be reduced (e.g., prevented).

Further advantageous configurations of the boosted internal combustion engine are described herein. Examples of the boosted internal combustion engine may be advantageous in which the axis is arranged close to the edge, that is to say close to an edge section of the flap. In this example, the flap may be laterally mounted and pivotable similarly to a door, specifically at one of its edges. This distinguishes the flap described herein from centrally mounted shut-off elements or flaps, such as for example a butterfly valve.

Embodiments of the boosted internal combustion engine may also be advantageous in which the axis is arranged close to the wall, that is to say close to a wall section of the intake system. The intake system may generally perform, with regard to the flap, the function of a frame, that is to say borders the flap. In this respect, an example in which the axis is arranged close to an edge section of the flap is generally also an embodiment in which the axis is arranged close to a wall section of the intake system. The major advantage of both examples is that, in the second end position, the flap may be positioned close to the wall, such that a free passage (e.g., a completely free passage) for the fresh air may be realized. The risk of the flap undesirably forming a flow obstruction is thereby reduced (e.g., minimized).

In another example, each partition in the boosted internal combustion engine may have a circumferential edge, and the edge may face toward the flap forms a circular arc, said circular arc may run around the axis of rotation of the pivotable flap.

The circular-arc-shaped edge of the partition enables the flap to be in engagement with the partitions such that it is or remains pivotable, and a small gap or gap-free form fit is realized between the flap and the partitions, which in turn allows a desired separation of the two gas phases.

Examples of the boosted internal combustion engine may be advantageous where the flow-guiding device includes a ring as a support for holding the two spaced-apart partitions.

A flow-guiding device of modular construction may be suitable in particular for the retrofitting of concepts already on the market, and for the combination of the individual components in accordance with the modular principle, whereby the multiple or varied use of individual components may be achieved.

As described herein a boosted internal combustion engine may be a turbocharged internal combustion engine or a supercharged internal combustion engine.

In this context, examples of the boosted internal combustion engine may be advantageous in which the ring may be arranged in the compressor housing.

Examples of the boosted internal combustion engine may however also be advantageous in which the two spaced-apart partitions are fastened to walls of the intake system. In individual cases, the partitions are of monolithic form, that is to say are formed integrally with the walls of the intake system or of the compressor housing.

Examples of the boosted internal combustion engine may be advantageous in which the flap may be, at the edge, equipped at least in sections with a sealing element which seals off the flap with respect to the two partitions and/or the valve housing.

The provision of a sealing element serves for the improved separation of exhaust gas and fresh air. Here, it may be taken into consideration that the partitions and the flap must be movable relative to one another, which makes the sealing much more difficult.

Examples of the boosted internal combustion engine are advantageous in which the at least one sealing element is elastically deformable.

In this context, examples of the boosted internal combustion engine may be advantageous in which the sealing element may have a strip-like form.

The flap may have a cutout or recess in the edge region for receiving a strip-like sealing element, such that the sealing element positioned in the cutout jointly forms the edge. Here, the flap serves as a carrier for receiving and stabilizing the sealing element.

Examples of the boosted internal combustion engine may also be advantageous in which the sealing element may have a bead-like form.

A bead-like sealing lip may protrude further in relation to a sealing element of strip-like form. The bead-like sealing lip may however also be positioned in a cutout or recess of the flap, but then has a relatively large part which may not arranged in the cutout or recess but which protrudes.

Examples of the boosted internal combustion engine may also be advantageous in which at least one exhaust-gas turbocharger may be provided which includes a turbine arranged in the exhaust-gas discharge system and a compressor arranged in the intake system. With regard to the above example, reference is made to the statements already made in conjunction with the exhaust-gas turbocharging arrangement, in particular the highlighted advantages.

In this context, examples of the boosted internal combustion engine may be advantageous in which the at least one compressor is the compressor of the at least one exhaust-gas turbocharger.

Examples of the boosted internal combustion engine may be advantageous in which the at least one compressor may have an inlet region which runs coaxially with respect to the shaft of the at least one impeller and which may be designed such that the flow of charge air approaching the at least one impeller runs substantially axially.

In the case of an axial inflow to the compressor, a diversion or change in direction of the charge-air flow in the intake system upstream of the at least one impeller may be omitted, whereby unwanted pressure losses in the charge-air flow owing to flow diversion may be reduced (e.g., avoided), and the pressure of the charge air at the inlet into the compressor may be increased. The absence of a change in direction may reduce the contact of the exhaust gas and/or charge air with the internal wall of the intake system and/or with the internal wall of the compressor housing, and thus may reduce the heat transfer and the formation of condensate.

An inlet region which runs and is formed coaxially with respect to the shaft of the at least one impeller may also facilitate the provision of a flow-guiding device described herein, which may interact with a pivotable flap.

In the case of at least one exhaust-gas turbocharger being used, low-pressure EGR may be advantageous. The main advantage of the low-pressure EGR arrangement may be that the exhaust-gas flow introduced into the turbine during exhaust-gas recirculation may not be reduced by the recirculated exhaust-gas flow rate. The entire exhaust-gas flow may also be available at the turbine for generating a desired amount of boost pressure.

The exhaust gas which is recirculated via the low-pressure EGR arrangement to the inlet side, and possibly cooled, is mixed with fresh air upstream of the compressor. The mixture of fresh air and recirculated exhaust gas produced in this way forms the charge air or combustion air which is supplied to the compressor and compressed.

Examples of the boosted internal combustion engine may be advantageous in which, for the adjustment of the recirculated exhaust-gas flow rate, a valve may be provided in the valve housing. The valve may include a valve body which is arranged on the back side of the flap and which is connected and thereby mechanically coupled to the flap, wherein the valve body shuts off the recirculation line in the second end position of the flap, in one example.

A pivoting of the flap causes an adjustment or movement of the valve in space. The flap consequently may serve as an actuating device for the valve. All variants of the above example have in common the fact that the flap to set the air flow rate supplied via the intake system, and not for the metering of the recirculated exhaust-gas flow rate. The latter may be effected by the valve, which is fitted in the recirculation line and/or lies on the mouth of the recirculation line and may serve as an EGR valve unit.

To improve the torque characteristic of the boosted internal combustion engine, it may be advantageous to provide two or more exhaust-gas turbochargers, for example multiple exhaust-gas turbochargers connected in series, in one example. In such an example, by connecting two exhaust-gas turbochargers in series, of which one exhaust-gas turbocharger serves as a high-pressure stage and one exhaust-gas turbocharger serves as a low-pressure stage, the compressor characteristic map can advantageously be expanded, specifically both in the direction of smaller compressor flows and also in the direction of larger compressor flows. However, in other examples, the boosted internal combustion engine may include a single turbocharger or the plurality of turbocharger may have a different arrangement, configurations, etc.

In particular, with the exhaust-gas turbocharger which serves as a high-pressure stage, it is possible for the surge limit to be shifted in the direction of smaller compressor flows, as a result of which high charge pressure ratios can be obtained even with small compressor flows, which considerably improves the torque characteristic in the lower engine speed range. This is achieved by designing the high-pressure turbine for small exhaust-gas mass flows and by providing a bypass line which, with increasing exhaust-gas mass flow, an increasing amount of exhaust gas is conducted past the high-pressure turbine.

Furthermore, the torque characteristic may be improved, in another example, by using of multiple turbochargers arranged in parallel, that is to say through the use of multiple turbines of relatively small turbine cross section arranged in parallel, wherein turbines are activated successively with increasing exhaust-gas flow rate.

A shift of the surge limit toward smaller charge-air flows may also be possible in the case of turbochargers arranged in parallel, such that, in the presence of low charge-air flow rates, it is possible to provide charge pressures which provide desired torque characteristic of the internal combustion engine at low engine speeds.

Furthermore, the response behaviour of an internal combustion engine supercharged in this way may be improved in relation to a similar internal combustion engine with a single exhaust-gas turbocharger, because the relatively small turbines are less inert, and the rotor of a smaller-dimensioned turbine and of a smaller-dimensioned compressor can be accelerated more rapidly.

Examples of the boosted internal combustion engine may be advantageous in which the junction point is formed and arranged in the vicinity of, at a distance Δ from, the at least one impeller. An arrangement of the junction point close to the compressor may counteract the formation of condensate.

In this context, examples are advantageous in which, for the distance Δ, the following applies: $\Delta \leq 2.0\ D_V$ or $\Delta \leq 1.5\ D_V$, where $D_V$ denotes the diameter of the at least one impeller. Embodiments are advantageous in which, for the distance Δ, the following applies: $\Delta \leq 1.0\ D_V$, preferably $\Delta \leq 0.75\ D_V$. However, other suitable dimensions of the valve and/or the impeller have been contemplated.

In one example, a boosted internal combustion engine is provided that may include an intake system for the supply of a charge-air flow, an exhaust-gas discharge system for the discharge of exhaust gas, at least one compressor arranged in the intake system, which compressor is equipped with at least one impeller which is mounted, in a compressor housing, on a rotatable shaft, an exhaust-gas recirculation arrangement comprising a recirculation line which branches off from the exhaust-gas discharge system and which opens into the intake system, so as to form a junction point, upstream of the at least one impeller, an exhaust-gas recirculation arrangement comprising a recirculation line which branches off from the exhaust-gas discharge system and which opens into the intake system downstream of the at least one impeller, and a valve unit which is arranged at the junction point in the intake system and which comprises a valve housing and a flap arranged in the valve housing, the flap, which is delimited circumferentially by an edge, being pivotable about an axis running transversely with respect to the fresh-air flow, in such a way that the flap, in a first end position, blocks the intake system by using a front side and opens up the recirculation line and, in a second end position, covers the recirculation line through an exhaust-gas-side back side and opens up the intake system.

An internal combustion engine of the type mentioned in the introduction is used as a motor vehicle drive. Within the context of the present description, the expression "internal combustion engine" encompasses diesel engines and Otto-cycle engines and also hybrid internal combustion engines, which utilize a hybrid combustion process, and hybrid drives which may include not only the internal combustion engine but also an electric machine which can be connected in terms of drive to the internal combustion engine and which receives power from the internal combustion engine or which, as a switchable auxiliary drive, additionally outputs power.

FIG. 1A shows, in a side view, a valve unit 3, arranged in the intake system 1, of a first example of an internal combustion engine 50 together with exhaust-gas recirculation arrangement 5, partially in section and with the flap 3*a* in the second end position (e.g., a closed position).

Figure 1B:
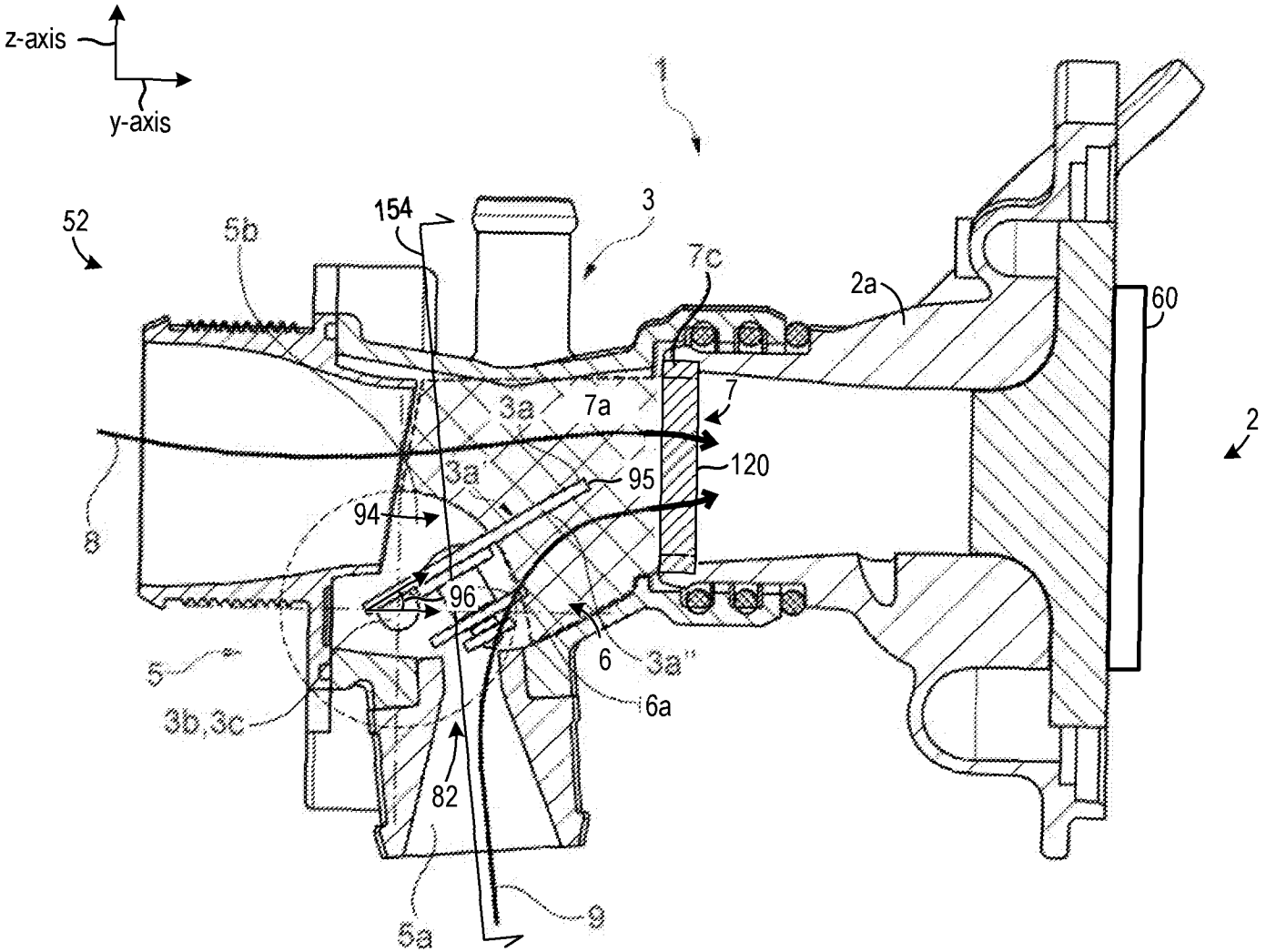
FIG. 1B shows, in a side view, the intake system of the internal combustion engine shown in FIG. 1 with the flap in an open position.
Figure 2:
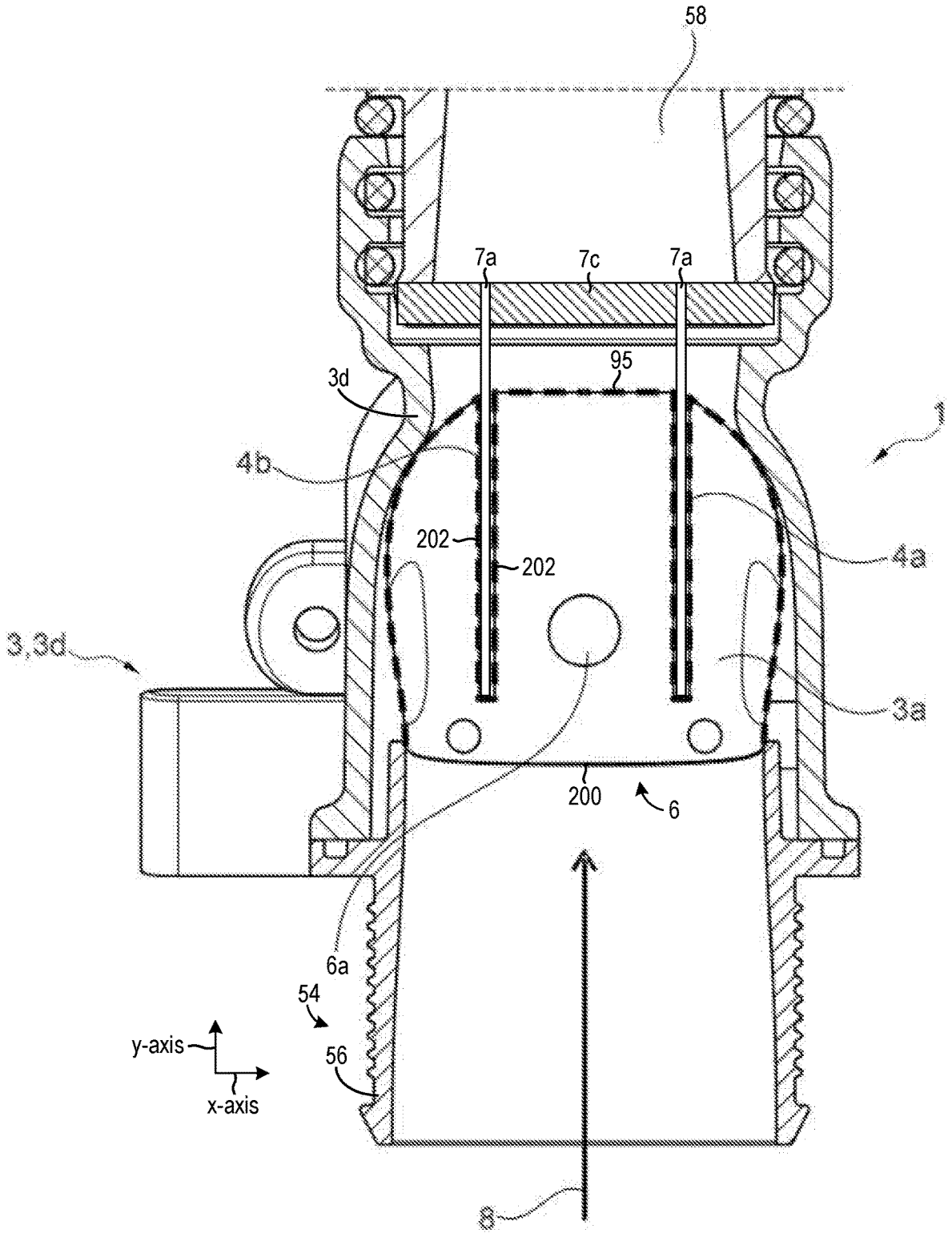
FIG. 2 shows, in a plan view, the intake system of the internal combustion engine shown in FIG. 1, partially in section.
Figure 3:
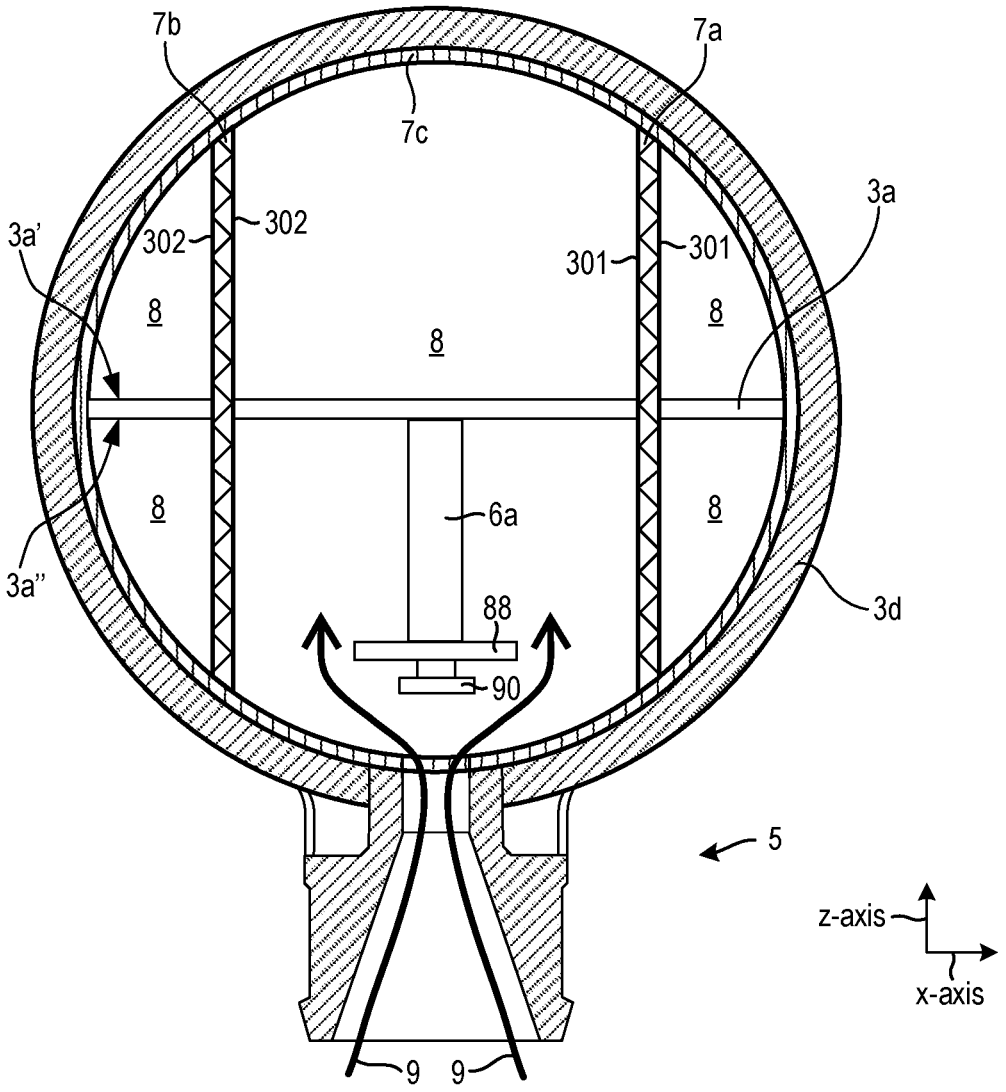
FIG. 3 shows, in a cross section through the flap, the embodiment illustrated in FIG. 1A, in a view in the flow direction.

The internal combustion engine 50 including an engine system 52. Reference axes 150 are shown in FIG. 1A as well as FIGS. 1B-4, for reference. The reference axes 150 include a z-axis, y-axis, and/or x-axis depending on the view in each of the figures. In one example, the z-axis may be parallel to a gravitational axis, the y-axis may be a longitudinal axis, and/or the x-axis may be a lateral axis. However, numerous orientations of the reference axes have been contemplated. Cutting plane 152 indicating the cross-sectional view shown in FIG. 2 is illustrated in FIG. 1A. Additionally, cutting plane 154 indicating the cross-sectional view shown in FIG. 3 are illustrated in FIG. 1B.

FIG. 1A show a connection conduit 54 including a conduit housing 56 (e.g., throttle plat defining a boundary of an airflow channel 57. In one example, the conduit housing 56 may be a throttle plate seat. However, the conduit housing 56 may be included in other suitable intake system components, in other examples. The connection conduit 54 may connect to upstream intake system components such as intake conduits, filters, etc. FIG. 1A also shows a valve housing 3*d* included in a valve unit 3 (e.g., EGR valve unit). The valve unit 3 also includes an EGR valve 6, discussed in greater detail herein. The valve housing 3*d* is coupled (e.g., directly coupled) to the conduit housing 56. A compressor housing 2*a* included in a compressor 2 is also shown in FIG. 1A. The compressor housing 2*a* is coupled (e.g., directly coupled) to the valve housing 3*d*. Additionally, the compressor housing 2*a* defines a boundary of a compressor inlet channel 58. The compressor inlet channel may be generally referred to as a compressor inlet. The compressor inlet channel 58 provide gas to an impeller 60 included in the compressor 2. Although the impeller 60 is schematically depicted, it will be appreciated that the impeller may have a profile that enables the density of the air flowing therethrough to be increased. For example, the impeller 60 may include blade which rotate around a central axis.

The engine system 52 may include a boosting device (e.g., turbocharger and/or supercharger). Therefore, the engine may be a boosted internal combustion engine. Specifically, in the illustrated example, the boosting device is an exhaust gas turbocharger 62. However, in other examples, the boosting device may be a supercharger. The exhaust gas turbocharger 62 includes a compressor 2 and a turbine 64 rotationally coupled to the compressor 2 via a shaft 66, indicated via an arrow, or other suitable mechanical component(s). The compressor 2 generates and supplies charge air to a cylinder 68. In this way, the turbocharger can boost the engine. The compressor 2 is therefore included in an intake system 1. Although a single cylinder is illustrated in FIG. 1A, it will be appreciated that in other examples the engine 50 may include an alternate number of cylinders. For instance, the engine 50 may include two or more cylinders which may be arranged in a variety of configurations such as an inline configuration, a horizontally opposed configuration, a v-type configuration, etc. The cylinder 68 may have an intake valve 70 and an exhaust valve 72 coupled thereto. The intake valve 70 inhibits and permits intake airflow into the cylinder 68 and the exhaust valve inhibits and permits exhaust gas flow to/from the cylinder. The intake and/or exhaust valves may be poppet valves or other suitable types of valves. Additionally, the valves may be cam actuated, in one example. However, in other examples, electronic valve actuation may be employed in the engine.

The turbine 64 is arranged in an exhaust-gas discharge system 74. The exhaust-gas discharge system 74 further includes an emission control device 76 positioned in an exhaust conduit 78. In the illustrated example, the emission control device 76 is located upstream of the turbine 64. However, in other examples, the emission control device 76 may be positioned downstream of the turbine 64. The emission control device 76 may include filters, catalysts, reductant injectors, etc., for reducing tailpipe emissions. An exhaust conduit 78 receives exhaust gas from the turbine 64.

FIG. 1A also shows a second exhaust-gas recirculation arrangement 97 including a recirculation line 98 extending between the intake system 1 at a location downstream of the compressor 2 and at a location in the exhaust-gas discharge system 74, upstream of the turbine 64, in the illustrated example. However, in other examples, the recirculation line 98 may be coupled to an exhaust conduit downstream of the turbine 64, in other examples. An EGR valve 99 is shown coupled to the recirculation line 98. The EGR valve 99 may be designed to permit and inhibit EGR gas flow through the recirculation line 98.

The compressor 2 has an impeller mounted rotatably in a compressor housing 2*a*, wherein the shaft 66 of the impeller lies in the plane of the drawing of FIG. 1A and runs horizontally. The compressor 2 has an inlet region which runs coaxially with respect to the shaft and is formed such that the section of the intake system 1 upstream of the compressor 2 does not exhibit any changes in direction, and the flow of the fresh air 8 approaching the compressor 2 and the impeller thereof runs substantially axially. However, it will be appreciated that the airflow in the compressor 2 may have greater complexity.

During engine operation, the cylinder 68 typically undergoes a four-stroke cycle including an intake stroke, compression stroke, expansion stroke, and exhaust stroke. During the intake stroke, generally, the exhaust valve closes and intake valve opens. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valve and the exhaust valve are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited via a spark from an ignition device, resulting in combustion. However, in other examples, compression may be used to ignite the air fuel mixture in the combustion chamber. During the expansion stroke, the expanding gases push the piston back to BDC. A crankshaft converts this piston movement into a rotational torque of the rotary shaft. During the exhaust stroke, in a traditional design, exhaust valve is opened to release the residual combusted air-fuel mixture to the corresponding exhaust passages and the piston returns to TDC.

The internal combustion engine 50 may also be equipped with an exhaust-gas recirculation arrangement 5 which includes a recirculation line 5*a* which opens into the intake system 1, so as to form a junction point 5*b*, upstream of the compressor 2. In the present case, the junction point 5*b* is arranged close to, at a small distance from, the compressor 2. The exhaust-gas recirculation arrangement 5 includes the recirculation line 5*a*. The recirculation line 5*a* includes a section 73 adjacent to the EGR valve 6 and a section 75 extending to the intake system 1. Thus, the recirculation line 5*a* extends between the intake system 1 and the exhaust-gas discharge system 74. Specifically, in the illustrated example, the recirculation line 5*a* includes an inlet 80 opening into the exhaust conduit 78 downstream of the turbine 64. Therefore, the exhaust-gas recirculation arrangement 5 may be a low-pressure exhaust-gas recirculation arrangement. However, in other examples, the recirculation line 5*a* may be coupled to a location in the exhaust-gas discharge system 74 upstream of the turbine 64. Additionally, the recirculation line 5*a* tapers in a direct toward the outlet 82 of the line. The tapered arrangement may increase EGR gas flow when the EGR valve unit is open which may decrease condensate formation and/or increase compressor efficiency. However, other recirculated exhaust gas line contours have been contemplated.

As illustrated in FIG. 1A, at the junction point 5*b* there is arranged the valve unit 3, which includes the valve housing 3*d* and a flap 3*a* arranged in the valve housing 3*d*. However, other valve unit positions have been contemplated.

FIG. 1A also shows an EGR valve 6 which is likewise positioned in the valve housing 3*d* serves for the adjustment of the recirculated exhaust-gas flow rate. The EGR valve 6 includes a valve body 6*a* which covers the recirculation line 5*a* in the illustrated position and which is connected, and thereby mechanically coupled, to the pivotable flap 3*a*, a pivoting of the flap 3*a* causing an adjustment of the valve body 6*a*, that is to say a movement or rotation of the valve body 6*a*, in space. Consequently, the flap 3*a* serves as an actuation mechanism for the valve 6 or the valve body 6*a*. The flap 3*a* may be actuated via an actuator 84.

The flap 3*a* is pivotable about an axis 3*b* running transversely with respect to the fresh-air flow. Thus, the flap 3*a* includes a pivot point 86.

The pivot point 86 in the illustrated example is at an upstream end 88 of the EGR valve 6. However, other pivot point positions have been contemplated.

The valve unit 3 and specifically the EGR valve 6 is illustrated in a closed configuration in FIG. 1A where the outlet 82 of the recirculation line 5*a* is blocked via a seal 88 included in the EGR valve. Specifically, the seal 88 seat and seals on a lip 89 of the outlet 82 in the closed configuration. The EGR valve 6 further includes a plug 90 extending into the line 5*a* in the closed configuration, providing another degree of sealing in the valve. However, other sealing arrangements have been contemplated. A valve body 91 extends between the seal 88 and the flap 3*a*. The valve body 91 is connected the seal 88 at a central position in the seal, in the illustrated example. Moreover, the valve body 91 is connected to a portion of the flap 3*a* that is offset from a center of the flap 3*a*. Specifically, the valve body 91 is coupled to an upstream side of the flap 3*a*. In this way, a downstream side of the flap 3*a* may extend further downstream from the outlet 82 of the recirculation line 5*a*. Consequently, the flap 3*a* may server to separate the EGR gas flow and the intake airflow to a greater extent, further reducing condensation formation in the compressor 2. However, other valve body arrangements have been contemplated.

Figure 4:
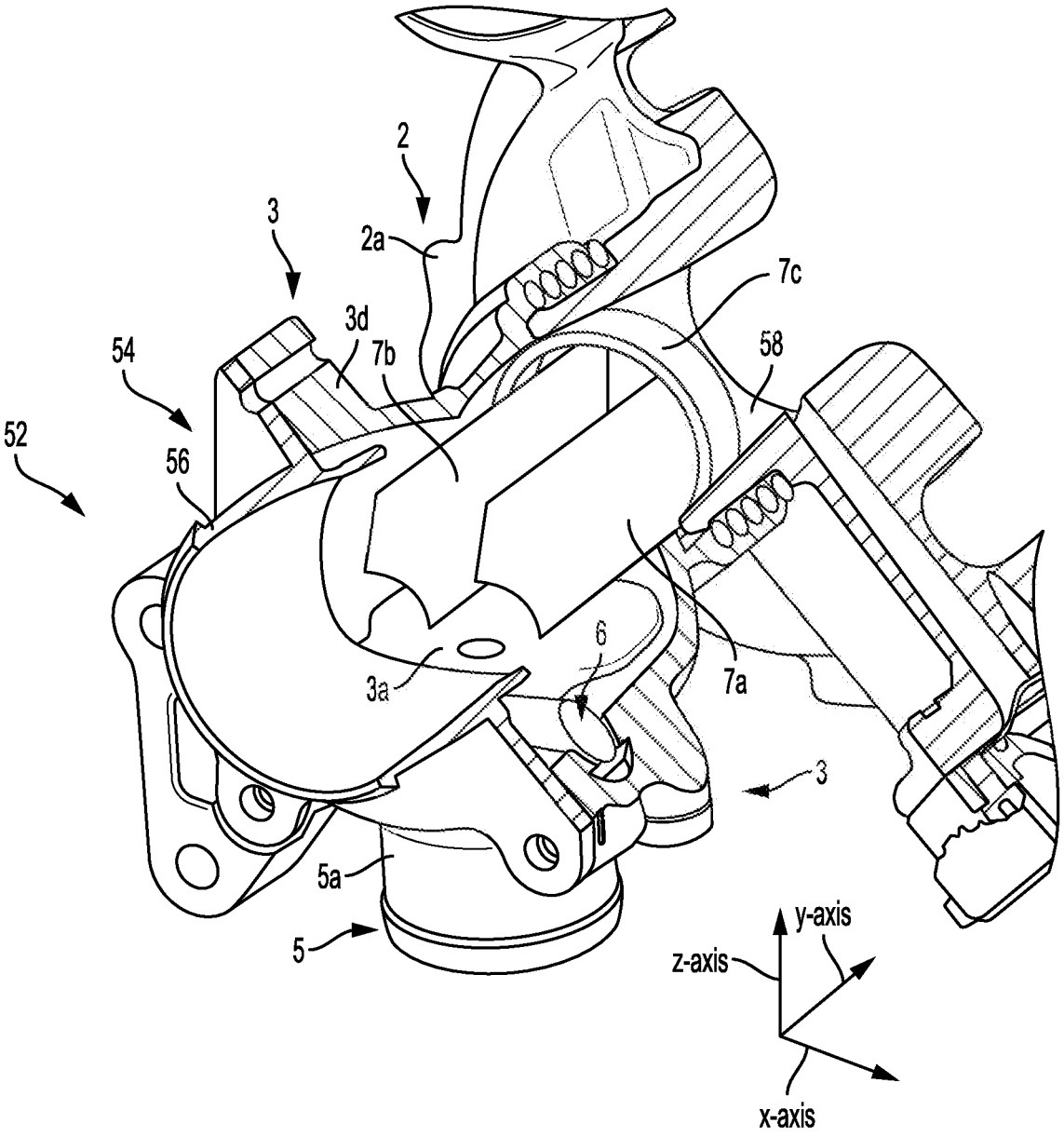
FIG. 4 shows a cut-away perspective view of the valve unit and exhaust gas recirculation arrangement shown in FIG. 1A.

A flow-guiding device 7 is also shown in FIG. 1A. The flow-guiding device 7 includes a first partition 7*a* and a second partition 7*b*. The second partition is hidden from view in FIG. 1A. However, the second partition is shown in FIGS. 3 and 4 and discussed in greater detail herein.

The first partition 7*a* includes a leading edge 92 with a curved section 93 accommodating pivotal movement of the flap 3*a* and the seal 88. Specifically, the curved section 93 may have a radius that is greater than or equal to a distance between the pivot point 86 of the flap 3*a* and a downstream point (e.g., outermost downstream point) in the seal 88. However, other structural relationships between the curved section of the first partition 7*a* and the EGR valve 6 have been contemplated. The first partition 7*a* functions to separate intake airflow from EGR flow when the EGR valve 6 is open and is discussed in greater detail herein.

Axis 3*b* runs transversely with respect to the fresh-air flow 8 and about which the flap 3*a* is pivotable is perpendicular to the plane of the drawing and serves as a mounting interface 3*c* for the flap 3*a*. In the present case, said axis 3*b* is arranged close to an edge section of the flap 3*a* and close to a wall section of the intake system 1 or of the valve unit 3, such that the flap 3*a* is laterally mounted, similarly to a door. Such an arrangement may facilitate greater separation between the EGR flow and the intake airflow when the EGR valve is open. However, other positions of the axis have been contemplated.

FIG. 1A also shows the flap 3*a* in a second end position (e.g., a closed position), in which the flap 3*a* extends approximately parallel to the virtual elongation of the compressor shaft. The back side 3*a*" of the flap 3*a* covers the recirculation line 5*a* of the exhaust-gas recirculation arrangement 5, whereas the intake system 1 is opened up. However, other closed contours of the flap have been contemplated.

The flap 3*a* serves for adjusting the air flow rate supplied via the intake system 1, and not for the metering of the recirculated exhaust-gas flow rate. The latter is performed by the EGR valve 6, wherein, in the second end position illustrated, the exhaust-gas recirculation arrangement 5 is deactivated.

The flap 3*a* has two spaced-apart, recesses 4*a*, 4*b*, which are of open form at that edge of the flap 3*a* which is situated opposite the axis of rotation 3*b* and which extend perpendicular to the axis of rotation 3*b* of the flap 3*a*, as can be seen from FIG. 2, which shows the example illustrated in FIG. 1A, in a plan view and partially in section. The recesses 4*a*, 4*b* may have a slot-like shape. As such, the recesses may be slot-like recesses, in one example. Moreover, the recesses may be mutually spaced apart. However, other recess contours and/or relative positions may be used.

As illustrated in FIG. 1A, a flow-guiding device 7 is provided in the intake system 1 between the axis of rotation 3*b* of the flap 3*a* and the impeller of the compressor 2.

Said flow-guiding device 7 includes two spaced-apart partitions 7*a*, 7*b*, which engage with the two recesses 4*a*, 4*b* of the flap 3*a* and of which one partition 7*b* is illustrated, or can be seen, in the side view in FIG. 1A. The two partitions may be referred to as a first partition 7*a* and a second partition 7*b*. The spaced-apart partitions may be mutually spaced apart, in one example. However, other flow-guiding device configurations have been contemplated. For instance, the flow-guiding device 7 may include more than two partitions, a single partition, etc., and/or the partitions may have another geometric relationship with the recesses and/or with each other.

As can be seen in FIG. 1B, the partitions 7*a*, 7*b* interact with the flap 3*a* such that the fresh air 8 and the recirculation line 5*a* are separated from one another, that is to say are kept separate from one another, in the flow-guiding device 7 when the exhaust-gas recirculation arrangement 5 is active. Consequently, the likelihood of condensation formation caused by the mixing of the EGR gas and the intake airflow is reduced.

The engine system 52 shown in FIG. 1A in one example may include the compressor 2, valve unit 3, and/or the flow-guiding device 7. However, it will be appreciated that the engine system 52 may include additional or alternative components, in other examples.

FIG. 1A also shows a controller 100 that may be included in the engine system 52. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 50, engine system 52, etc. The sensors may include mass airflow sensor 114, manifold pressure sensor (not shown), etc.

Additionally, the controller 100 may be configured to trigger one or more actuators and/or send commands to components. For instance, the controller 100 may trigger adjustment of the valve unit 3 including the EGR valve 6, EGR valve 99, throttle (not shown), etc. Specifically in one example, the controller 100 may send a control signal to the valve unit 3 vary the flow of EGR into the compressor inlet. For instance, the valve may be opened to increased EGR flow during a first set of operating conditions and closed to decrease EGR flow during another set of operating conditions. In this way, the EGR valve 6 may adjusted to alter the flowrate of EGR in the engine to increase combustion efficiency and/or reduce emissions, if desired. Therefore, the controller 100 receives signals from the various sensors and employs the various actuators to adjust engine operation based on the received signals and instructions stored in memory (e.g., non-transitory memory) of the controller. Thus, it will be appreciated that the controller 100 may send and receive signals from the engine system 52.

In yet another example, the amount of component, device, actuator, etc., adjustment may be empirically determined and stored in predetermined lookup tables and/or functions. For example, one table may correspond to EGR flow conditions during warm-up and/or low engine speeds while another table may correspond to EGR flow conditions after warm-up and/or higher engine speeds. However, numerous tables providing a framework for actuator adjustment have been contemplated.

FIG. 1A also shows a carrier housing 7*c* (e.g., a carrier ring) adjacent to the interface (e.g., overlapping region) between the valve housing 3*d* and the compressor housing 2*a*. Specifically, the valve housing 3*d* and the compressor housing 2*a* at least partially circumferentially surround the carrier housing 7*c*. However, in other examples, the compressor housing 2*a* or the valve housing 3*d* may at least partially circumferentially surround the carrier housing 7*c*. Additionally, in one example, the carrier housing 7*c* may be coupled (e.g., fixedly attached) to the compressor housing 2*a* and/or the valve housing 3*d*. Furthermore, in the present case, the flow-guiding device 7 includes the carrier housing 7*c*. The carrier housing 7*c* receives the two partitions 7*a*, 7*b*. The carrier housing 7*c* may have an annular shape, in one example, and therefore may be referred to as a carrier ring. However, numerous carrier housing profiles have been contemplated such as oval cross-sectional shapes, rectangular cross-sectional shapes, etc. The carrier housing 7*c* may structurally reinforce the first and second partitions 7*a*, 7*b*. As such, the carrier housing 7*c* may be coupled (e.g., fixedly coupled) the first and second partitions, 7*a*, 7*c*. For instance, the partitions may be welded to the housing, cast with the housing as a single component, etc. However, the carrier housing 7*c* may be omitted from the flow-guiding device 7, in other examples. In such an example, the partitions 7*a*, 7*b* may be coupled to the valve housing 3*d*.

It will be appreciated that, in one example, the flow mixing between the EGR gas and the intake air may occur at or downstream of a trailing edge 120 of the carrier housing 7*c*. In this way, condensate formation may be delayed when compared to previous EGR valves where the mixing takes place at a leading edge of a valve plate, thereby reducing the amount of condensate interfering with compressor operation. In other words, the area (e.g., axial length of the conduit) where condensate may be formed upstream of the compressor is reduced. Consequently, engine efficiency may be increased along with compressor longevity. Although, the partitions 7*a*, 7*b* do not extend downstream past the housing 7*a* in the example depicted in FIG. 1A, in other examples, the partitions may extend downstream of the trailing edge 120 of the carrier housing 7*c* to further delay condensate formation. Specifically, in one example, the partitions 7*a*, 7*b* may extend downstream to a trailing side 122 of the valve housing 3*d*. However, numerous suitable partition profiles have been contemplated.

FIG. 1B shows, in a side view, the example illustrated in FIG. 1A, with the flap 3*a* in an open position, in which the flap 3*a* has been pivoted counterclockwise through a certain angle about the axis of rotation 3*b*. As a result, the flap 3*a*, with its front side 3*a*', shuts off the intake system 1 to a certain extent, whereas the valve body 6*a* of the EGR valve 6 opens up the recirculation line 5*a*, such that the exhaust gas from line 5*a* is introduced into the intake system 1.

An edge of each partition 7*a*, 7*b* which faces toward the flap 3*a* forms a circular arc which runs around the axis of rotation 3*b* of the flap 3*a*. The circular-arc-shaped form of the edge allows the flap 3*a* engaging with the partitions 7*a*, 7*b* to be pivotable, and at the same time and as far as possible gap-free form fit is realized between the flap 3*a* and the partitions 7*a*, 7*b*. This ensures an effective separation of the fresh air 8 from the exhaust gas 9, generally indicated via an arrow.

The partitions 7*a*, 7*b* additionally extend across the valve housing 3*d*, in the illustrated example. Thus, the partitions 7*a*, 7*b* extend across the valve housing 3*d* that defines a boundary of an airflow duct 94 upstream of the compressor impeller 60. In this way, the partitions can divide the airflow in the airflow duct to reduce mixing between EGR gas and intake air to reduce condensate formation upstream of the impeller. Consequently, noise generated in the intake system may be reduced and the likelihood of damage to the blades of the impeller are also reduced, thereby increasing compressor efficiency and compressor longevity. As a result, the compressor 2 may provide more boost to the cylinder 68, thereby increasing engine efficiency and reducing engine emissions.

FIG. 1B also shows the flap 3*a* extending into the airflow duct 94 and spaced away from the outlet 82 of the recirculation line 5*a*. As such, the flap 3*a* not only allows the EGR flow to be regulated but also may act to adjust the air flow rate flowing through the airflow duct which is supplied to the downstream cylinder. Consequently, a desired amount of airflow and EGR flow provided to the compressor may be achieved if desired. However, in other configurations the flap may be used that do not have such an influence on the airflow rate.

The relative position between the flap 3*a* and the partitions in the flow-guiding device 7 varies when the EGR valve 6 is moved from an open configuration to a closed configuration or vice versa. For instance, as shown in FIG. 1B, a trailing edge 95 of the flap move up the partitions 7*a*, 7*b*, with regard to the z-axis, when the EGR valve 6 is moved into various open configurations. Thus, an angle 96 formed between an axis parallel to the y-axis and the flap 3*a* may increase as the valve is opened. Conversely, the angle 96 decreases as the valve is transitioned into a closed configuration. It will be appreciated that FIG. 1B shows a more focused illustration of the engine system 52, shown in FIG. 1A. As such, the engine 50, controller 100, etc., have been omitted from FIG. 1B to allow for easier reference of components in the engine system 52. However, it will be appreciated that the engine system 50 shown in FIG. 1B may be included in the engine 50 shown in FIG. 1A and therefore include similar components. Furthermore, the second partition 7*b* is hidden from view in FIG. 1B.

FIG. 1B also shows the compressor 2 including the impeller 60, the exhaust-gas recirculation arrangement 5, recirculation line 5*a*, axis 3*b*, flap 3*a*, mounting interface 3*c*, junction point 5*b*, airflow 8, EGR flow 9, flow-guiding device 7 including the first partition 7*a*, carrier housing 7*c*, valve unit 3, intake system 1, and valve body 91.

Turning again to FIG. 2, the general direction of airflow into the connection conduit 54 is illustrated via arrow 8. The intake system 1 is again indicated. The housing 56 of the connection conduit 54 are also shown in FIG. 2. The valve unit 3 is also shown in FIG. 2 including the valve housing 3*d* that is coupled to the housing 56 of the connection conduit 54. The compressor housing 2*a* including the compressor inlet channel 58 is also shown in FIG. 2.

FIG. 2 additionally shows the EGR valve 6 included in the valve unit 3. The valve body 91 coupled to the flap 3*a* is also shown in FIG. 2. Specifically, in the illustrated example, the recesses 4*a*, 4*b* have a slot-like shape with two opposing sides 202 (e.g., planar sides) that are parallel to one another which extend longitudinally down the flap 3*a*. However, other recess contours may be used in other examples.

The recesses 4*a*, 4*b* enable movement between the flow-guiding device 7 and the flap 3*a* during actuation of the EGR valve 6. Specifically, the recesses 4*a*, 4*b* allow the flap 3*a* to be pivoted during actuation without striking the partitions in the flow-guiding device 7. In this way, recesses do not interfere with EGR valve actuation.

The recesses 4*a*, 4*b* extend from the trailing edge 95 of the flap 3*a* toward a leading edge 300 of the flap, in a longitudinal direction. However, the recesses 4*a*, 4*b* do not extend all the way to the leading edge 200. In this way, the flap 3*a* can retain a continuous shape while accommodating the interaction between the flap and the partitions 7*a*, 7*b*, shown in FIG. 3 and discussed in greater detail herein.

FIG. 2 again shows the partitions 7*a*, 7*b* coupled to the carrier housing 7*c* and positioned in the recesses 4*a*, 4*b*, respectively. As previously discussed, the relative position between the partitions 7*a*, 7*b* and the flap 3*a* varies as the EGR valve 6 is actuated to enable flow channels separating the intake air and the EGR to be maintained when the EGR valve is opened. Consequently, condensate formation upstream of the compressor is reduced.

FIG. 3 shows, in a cross section through the flap 3*a*, the example illustrated in FIG. 1A, in a view in the flow direction, that is to say in a view in the direction of the compressor. It is sought merely to explain the additional features in relation to the other figures, for which reason reference is made otherwise to the figure descriptions above. The same reference signs have been used for the same parts and components.

As can be seen from FIG. 3, the partitions 7*a*, 7*b* interact with the flap 3*a* such that the fresh air 8 and the recirculated exhaust gas 9 are kept separate from one another in the flow-guiding device 7 when the exhaust-gas recirculation arrangement 5 is active and the EGR valve 6 is open.

FIG. 3 also shows the first partition 7*a* including two planar sides 300. The planar sides 300 are parallel to one another, in the illustrated example. Moreover, the planar sides are parallel to a plane formed between the z-axis and the y-axis, in the depicted example. It will be appreciated that the y-axis in the view shown in FIG. 3 extends into and out of the page. The second partition 7*b* also includes two planar sides 302. The two planar sides 302 are parallel to one another and are parallel to the first partition 7*a*, in the depicted example. However, the first partition 7*a* may not be parallel to the second partition 7*b* in other examples.

Arranging (e.g., vertically arranging) the first partition 7*a* and the second partition 7*b* parallel to the z-y plane allows the flap 3*a* to move freely upward with regard to the partition. As such, the flap 3*a* may be actuated while the partitions retain flow separation. Moreover, the first partition 7*a* and the second partition 7*b* are coupled (e.g., fixedly coupled) to the valve housing 3*d*.

FIG. 3 also shows the seal 88 and the plug 90 coupled to the flap 3*a* via the valve body 91. Additionally, FIG. 3 shows the recirculation line 5*a* in the exhaust-gas recirculation arrangement 5. Additionally, FIG. 3 shows the carrier housing 7*c* coupled to the partitions 7*a*, 7*b*.

FIG. 4 show a cut-away perspective view of the engine system 52 including the valve unit 3. The exhaust-gas recirculation arrangement 5 including the recirculation line 5*a* is also shown in FIG. 4. The connection conduit 54 including the conduit housing 56 is again shown in FIG. 4. The compressor inlet channel 58 are also shown with the flow-guiding device 7 including the first partition 7*a* and the second partition 7*b*.

Additionally, FIG. 4 shows the valve unit 3 including the EGR valve 6 having the flap 3*a*. Specifically, in the illustrated example, the EGR valve unit 3 is in the closed configuration. In the closed configuration the flap 3*a* is arranged perpendicular to the first partition 7*a* and the second partition 7*b*. Such an arrangement between the flap and partitions may increase the intake airflow into the compressor impeller 60, shown in FIG. 1A. However, other relative positions between the partitions and the valve flap in the closed configuration, have been contemplated. Furthermore, the carrier housing 7*c* (e.g., carrier ring) is illustrated in FIG. 4. The first and second partitions, 7*a*, 7*b* are shown coupled to the carrier housing 7*c* and extending across the carrier housing. As previously discussed, the carrier housing 7*c* serves to structurally support the partitions. However, it will be appreciated that the carrier housing 7*c* may be omitted from the engine system 52, in some examples.

FIGS. 1A-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The engine system described herein provide the technical effect of decreasing condensation formation upstream of a compressor impeller. Consequently, noise generated in the intake system may be reduced and the likelihood of damage to the blades of the impeller are also reduced, thereby increasing compressor efficiency and compressor longevity.

The invention will be further described in the following paragraphs. In one aspect, an internal combustion engine is provided that includes an intake system for the supply of a charge-air flow to a cylinder, an exhaust-gas discharge system discharging exhaust gas from the cylinder, at least one compressor arranged in the intake system, where the compressor is equipped with at least one impeller which is mounted, in a compressor housing, on a rotatable shaft, a first exhaust-gas recirculation arrangement comprising a recirculation line branching off from the exhaust-gas discharge system and opens into the intake system, so as to form a junction point, upstream of the at least one impeller, a valve unit which is arranged at the junction point in the intake system and which comprises a valve housing and a flap arranged in the valve housing, the flap, which is delimited circumferentially by an edge, being pivotable about an axis of rotation running transversely with respect to a fresh-air flow, in such a way that the flap, in a first end position, blocks the intake system by a front side and opens up the recirculation line and, in a second end position, covers the recirculation line by an exhaust-gas-side back side and opens up the intake system, and a flow-guiding device is provided in the intake system between the axis of rotation of the flap and the at least one impeller, which flow-guiding device comprises two spaced-apart partitions, where the flap has two spaced-apart, recesses, which recesses are formed so as to be open at the edge of the flap which is situated opposite the axis of rotation and extend perpendicular to the axis of rotation of the flap, and where the two spaced-apart partitions engage with the two recesses such that the two spaced-apart partitions in interaction with the flap separate the fresh air and the recirculated exhaust gas from one another.

In another aspect, an engine system is provided that includes a compressor including an inlet upstream of an impeller and a compressor housing, a flow-guiding device including a first partition extending across a valve housing, where the valve housing defines a boundary of an airflow duct, and a valve unit including, an exhaust gas recirculation (EGR) valve coupled to a junction point between an EGR conduit and compressor inlet and including and a flap having a recess mating with the first partition, a valve housing coupled to the compressor housing, where during actuation of the EGR valve unit a relative position between the recess in the flap and the first partition is varied.

In another aspect an engine system is provided that includes a flow-guiding device including a first partition extending across a valve housing, and where the valve unit includes, an exhaust gas recirculation (EGR) valve positioned between a compressor inlet and an EGR conduit and including a flap having a recess mating with the first partition and pivoting about a mounting interface adjacent to a leading edge of the flap to vary the relative position between the recess and the first partition.

In any of the aspects or combinations of the aspects, the engine system may further include a second partition extending across the valve housing and arranged parallel to the first partition.

In any of the aspects or combinations of the aspects, the recess may extend only down a portion of the flap in a direction parallel to a central axis of the inlet.

In any of the aspects or combinations of the aspects, the first partition may be fixedly attached to the valve housing.

In any of the aspects or combinations of the aspects, the axis may be arranged close to an edge section of the flap.

In any of the aspects or combinations of the aspects, the axis may be arranged close to a wall section of the intake system.

In any of the aspects or combinations of the aspects, each of the two spaced-apart partitions may circumferentially have an edge, and the edge facing toward the flap may form a circular arc, said circular arc running around the axis of rotation of the flap.

In any of the aspects or combinations of the aspects, the flow-guiding device may include a ring as a support for holding the two spaced-apart partitions.

In any of the aspects or combinations of the aspects, the ring may be arranged in the compressor housing.

In any of the aspects or combinations of the aspects, the two spaced-apart partitions may be fastened to walls of the intake system.

In any of the aspects or combinations of the aspects, the flap may be, at the edge, equipped at least in sections with a sealing element which seals off the flap with respect to the two spaced-apart partitions and/or the valve housing.

In any of the aspects or combinations of the aspects, the sealing element may have a strip-like form.

In any of the aspects or combinations of the aspects, the sealing element may have a bead-like form.

In any of the aspects or combinations of the aspects, at least one exhaust-gas turbocharger may be provided which may include a turbine arranged in the exhaust-gas discharge system and a compressor arranged in the intake system.

In any of the aspects or combinations of the aspects, the at least one compressor may be the compressor of the at least one exhaust-gas turbocharger.

In any of the aspects or combinations of the aspects, where, for the adjustment of the recirculated exhaust-gas flow rate, a valve may be provided in the valve housing, which valve comprises a valve body which is arranged on the back side of the flap and which is connected and thereby mechanically coupled to the flap, wherein the valve body shuts off the recirculation line in the second end position of the flap.

In any of the aspects or combinations of the aspects, the internal combustion engine may further include a second exhaust-gas recirculation arrangement including a recirculation line which branches off from the exhaust-gas discharge system and which opens into the intake system downstream of the at least one impeller.

In any of the aspects or combinations of the aspects, the first partition may be fixedly coupled to the housing of the inlet.

In any of the aspects or combinations of the aspects, the partition may vertically extend across the housing.

In any of the aspects or combinations of the aspects, the engine system may further include a second partition extending across the housing and is arranged parallel to the first partition.

In any of the aspects or combinations of the aspects, the first partition may include two planar sides.

In any of the aspects or combinations of the aspects, the recess may extend only down a portion of the flap in a direction parallel to a central axis of the inlet.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine comprising:

an intake system for the supply of a charge-air flow to a cylinder;

an exhaust-gas discharge system discharging exhaust gas from the cylinder;

at least one compressor arranged in the intake system, where the compressor is equipped with at least one impeller which is mounted, in a compressor housing, on a rotatable shaft;

a first exhaust-gas recirculation arrangement comprising a recirculation line branching off from the exhaust-gas discharge system and opens into the intake system, so as to form a junction point, upstream of the at least one impeller;

a valve unit which is arranged at the junction point in the intake system and which comprises a valve housing and a flap arranged in the valve housing, the flap, which is delimited circumferentially by an edge, being pivotable about an axis of rotation running transversely with respect to a fresh-air flow, in such a way that the flap, in a first end position, blocks the intake system by a front side and opens up the recirculation line and, in a second end position, covers the recirculation line by an exhaust-gas-side back side and opens up the intake system; and a flow-guiding device is provided in the intake system between the axis of rotation of the flap and the at least one impeller, where the flow-guiding device comprises two spaced-apart partitions;

where the flap has two spaced-apart recesses, which recesses are formed so as to be open at the edge of the flap which is situated opposite the axis of rotation and extends perpendicular to the axis of rotation of the flap; and where the two spaced-apart partitions engage with the two recesses such that the two spaced-apart partitions in interaction with the flap separate fresh air and recirculated exhaust gas from one another.

2. The internal combustion engine of claim 1, where the axis of rotation is arranged close to an edge section of the flap.

3. The internal combustion engine of claim 1, where the axis of rotation is arranged close to a wall section of the intake system.

4. The internal combustion engine of claim 1, where each of the two spaced-apart partitions circumferentially has an edge, and the edge facing toward the flap forms a circular arc, said circular arc running around the axis of rotation of the flap.

5. The internal combustion engine of claim 1, where the flow-guiding device comprises a ring as a support for holding the two spaced-apart partitions.

6. The internal combustion engine of claim 5, where the ring is arranged in the compressor housing.

7. The internal combustion engine of claim 1, where the two spaced-apart partitions are fastened to walls of the intake system.

8. The internal combustion engine of claim 1, where the flap is, at the edge, equipped at least in sections with a sealing element which seals off the flap with respect to the two spaced-apart partitions and/or the valve housing.

9. The internal combustion engine of claim 8, where the sealing element has a strip-like form.

10. The internal combustion engine of claim 8, where the sealing element has a bead-like form.

11. The internal combustion engine of claim 1, where at least one exhaust-gas turbocharger is provided which comprises a turbine arranged in the exhaust-gas discharge system and a compressor arranged in the intake system.

12. The internal combustion engine of claim 11, where the at least one compressor is the compressor of the at least one exhaust-gas turbocharger.

13. The internal combustion engine of claim 1, where, for adjustment of a recirculated exhaust-gas flow rate, a valve is provided in the valve housing, where the valve comprises a valve body which is arranged on a back side of the flap and which is connected and thereby mechanically coupled to the flap, wherein the valve body shuts off the recirculation line in the second end position of the flap.

14. The internal combustion engine of claim 1, further comprising a second exhaust-gas recirculation arrangement including a recirculation line which branches off from the exhaust-gas discharge system and which opens into the intake system downstream of the at least one impeller.

15. An engine system, comprising:

a compressor including an inlet upstream of an impeller and a compressor housing;

a flow-guiding device including a first partition extending across a valve housing, where the valve housing defines a boundary of an airflow duct; and a valve unit including;

the valve housing;

an exhaust gas recirculation (EGR) valve coupled to a junction point between an EGR conduit and a compressor inlet and including and a flap having a recess mating with the first partition and pivoting about a mounting interface adjacent to a leading edge of the flap;

a valve housing coupled to the compressor housing;

where during actuation of the EGR valve a relative position between the flap and the first partition is varied.

16. The engine system of claim 15, where the first partition is fixedly coupled to the valve housing of the compressor inlet, the first partition vertically extends across the valve housing, and/or the first partition includes two planar sides.

17. The engine system of claim 15, further comprising a second partition extending across the valve housing and arranged parallel to the first partition.

18. An engine system, comprising:

a flow-guiding device including a first partition extending across a valve housing; and an exhaust gas recirculation (EGR) valve positioned between a compressor inlet and an EGR conduit and including a flap having a recess mating with the first partition and pivoting about a mounting interface adjacent to a leading edge of the flap to vary a relative position between the flap and the first partition.

19. The engine system of claim 18, further comprising a second partition extending across the valve housing and arranged parallel to the first partition.

20. The engine system of claim 18, where the first partition is fixedly attached to the valve housing and where the recess extends only down a portion of the flap in a direction parallel to a central axis of the compressor inlet.

* * * * *